US005783762A

United States Patent [19]

Lindauer

[11] Patent Number: 5,783,762

[45] Date of Patent: Jul. 21, 1998

[54] BOW FROG COVER

[76] Inventor: Diana E. Lindauer, 831 E. Ridge Rd., SE., Corydon, Ind. 47112

[21] Appl. No.: 541,133

[22] Filed: Oct. 11, 1995

[51] Int. Cl.[6] ..... G10D 1/00

[52] U.S. Cl. ..... 84/282; 84/453; D17/20

[58] Field of Search ..... 84/282, 453; D17/20

[56] References Cited

U.S. PATENT DOCUMENTS

| | | | |
|---|---|---|---|
| D. 286,543 | 11/1986 | Jablonski | D17/20 |
| 675,726 | 6/1901 | Gaston | 84/282 |
| 1,435,926 | 11/1922 | Johnson | 84/282 |
| 2,820,388 | 1/1958 | Rolland | 84/282 |
| 3,839,938 | 10/1974 | Williams | 84/465 |
| 3,877,501 | 4/1975 | Toth | 84/453 |
| 3,919,912 | 11/1975 | Darling | 84/282 |
| 4,742,754 | 5/1988 | Janello | 84/453 |

*Primary Examiner*—Cassandra C. Spyrou
*Attorney, Agent, or Firm*—David W. Carrithers

[57] ABSTRACT

A bow frog cover for covering the exterior surface of the gripping portion of the bow frog of a bow of a violin or other musical instrument utilizing a bow, to protect the frog and portion of the stick adjacent the frog from perspiration and oil from the users fingers and to provide a good grip of the frog.

14 Claims, 3 Drawing Sheets

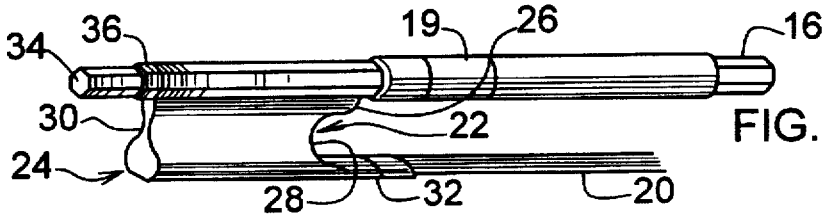
FIG. 2
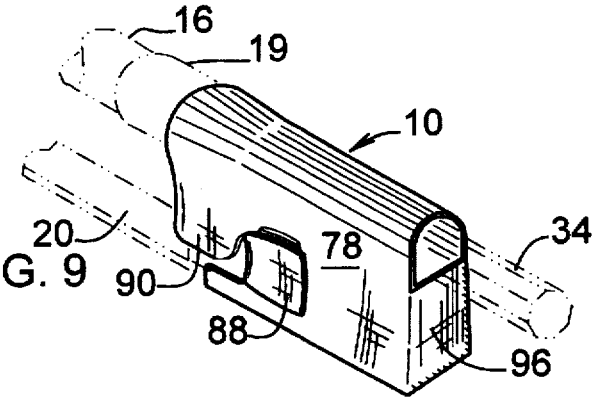
FIG. 9
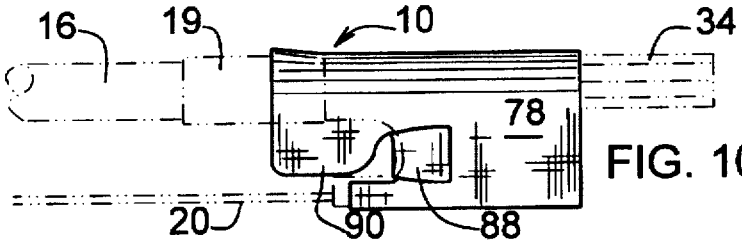
FIG. 10
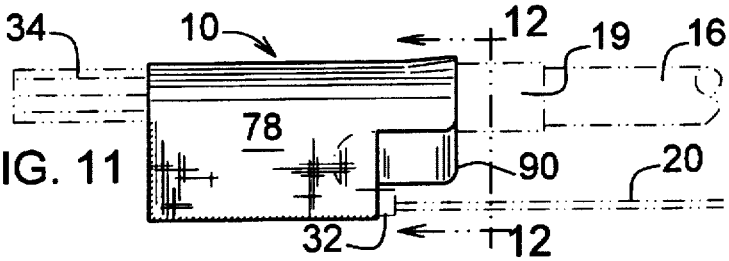
FIG. 11
FIG. 12
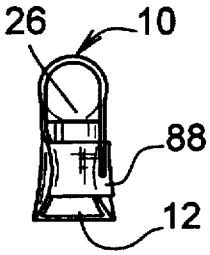
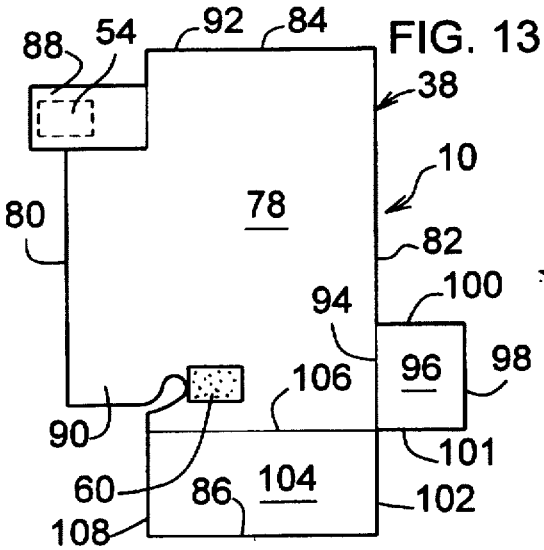
FIG. 13
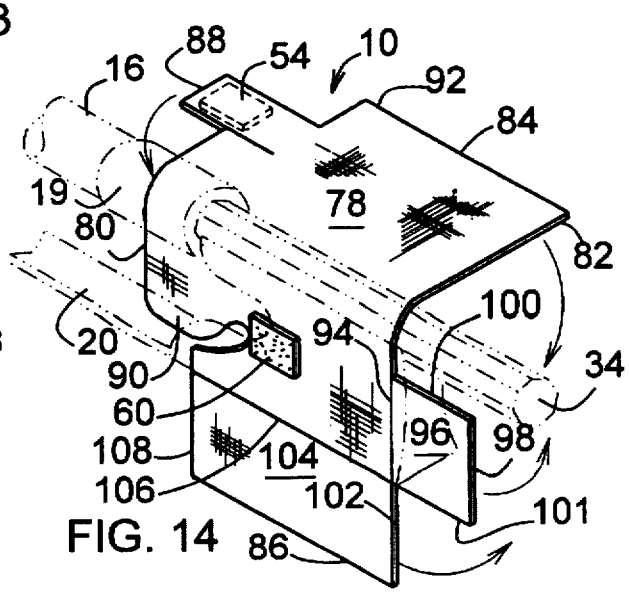
FIG. 14

BOW FROG COVER

BACKGROUND OF THE INVENTION

The present invention relates to a means for covering the exterior surface of the gripping frog portion of a bow of a musical instrument such as a violin to protect the frog and portion of the stick adjacent to the frog from perspiration and oil from the users fingers and to provide the user with a good grip of the bow at the bow frog.

Typically musical instruments utilizing a bow such as a violin, viola, or cello consists of bow including a rod or stick, a tip unit at one end of the rod, and a frog unit at the other end of the rod. The frog unit is longitudinally movable relative to the tip unit, and hair or other fiber is held taut between the tip unit and the frog unit. A generally cylindrical guard consisting of a resilient material such as leather usually covers a portion of the stick adjacent the frog.

The frog cover of the instant invention provides a means to prevent deterioration of the stick and frog of the violin, viola, or cello bows from the musician's perspiration. The frog cover is designed to protect any area of the bow frog that may be in constant contact with the hand and fingers during use, as well as portions of the stick adjacent the frog which may come in contact with the hand and fingers during use.

Bows are made with more or less valuable materials. Fine bows are made with expensive high quality materials that are susceptible to deteriorating quickly in humid conditions such as are created by a player's hand. The portion of the bow in contact with the hand is comprised of some grade of pernambuco wood. The finest pernambuco wood having been found and used in the early 19th century (until the end of the century). Fine bows are valued in part because there is not a reliable supply of high grade pernambuco, which is considered the best wood for the stick. The bow frog is usually constructed of materials made of ebony, other materials including mother-of-pearl, tortoise-shell, ivory, pearl, gold, silver or other fine inlay or even decorative jewels. The area of the frog where the thumb of the player touches the stick sometimes wears down, as does the leather or other material comprising the guard in that area. The stick is sometimes stamped with a maker or other indicator of origin. The stamps are important to establish the authenticity of the bow; however, the stamp may eventually be worn away with constant handling and use of the bow. All of the bow pieces are susceptible to damage from moisture and wear. For instance, the finish on the stick may become dull or even discolored due to moisture.

The present invention provides a frog cover which may easily be mounted on a bow frog, and which, when so mounted, provides an adsorbent material having a natural feel for properly grasping the bow at the frog and providing maximum manipulation.

Another object of this invention is to make such an attachment which is cheap and easy to manufacture, and which may be made up of a variety of different materials.

Another object of the instant invention is to provide an attachment which may easily be mounted on a bow, and which, when so mounted, does not hinder (DEL Oct. 6, 1995) the proper grasping of the bow and its manipulation.

Yet another object is to provide a frog cover fabricated from readily available materials such as leather, cloth, flexible plastic, velour, or other material providing the requisite moisture protection and/or gripping properties necessary for manipulation of the bow.

SUMMARY OF THE INVENTION

The present invention relates to a means for covering the exterior surface of the gripping portion for a bow at the frog of a violin or bow of an other musical instrument to protect the frog from perspiration and oil from the users fingers and to provide a good grip on the frog.

The frog cover is designed for covering a bow frog. The frog cover comprises at least one sheet of material for removably wrapping around a bow frog and a portion of a bow rod adjacent to the frog. The sheet of material has a front edge, a rear edge, a first side edge, and a second side edge. The first and the second side edges are connected together. The frog cover includes a means for holding the sheet of material in position around the frog.

Moreover, the means for holding the sheet of material in position around the frog comprises a tab having a first holding means extending frontwardly from the lower portion of either the first or the second side edge to the opposite adjacent lower side edge of the sheet of material which includes a second holding means in cooperative engagement with the first holding means for removably securing the tab to the edge.

More particularly, the frog cover is formed from one or two sheets of material defining a front edge, rear edge, first side edge, second side edge, tab including a first hook and loop holding means, first side supporting edge, second side supporting edge, hook and loop holding means for cooperative engagement with a second hook and loop holding means for removing securing the frog cover immovably around the frog. The frog cover is formed by connecting by glue or thread, the side edges of the sheet(s), and the rear edge of the sheet to edges of the flap. A unitary, one piece frog cover 10 is formed by connecting the edges of the sheet(s) together.

The front edge of the sheet(s) is folded around the top of the rod joining the frog, and the side edges are folded around the lower hair carrying leg of the frog. The flap is wrapped securely around the U shaped notch between the front upper bow engaging leg and lower hair engaging leg and secured thereto by the cooperative engagement of the hook and loop fastening means.

BRIEF DESCRIPTION OF THE DRAWINGS

A better understanding of the present invention will be had upon reference to the following description in conjunction with the accompanying drawings in which like numerals refer to like parts throughout the several views and wherein:

FIG. 2 is a perspective view of a bow frog;

FIG. 9 is an enlarged perspective view of an alternate embodiment of the frog cover of the present invention showing the stick in phantom lines;

FIG. 10 is a left side view of the frog cover of FIG. 9 invention showing the stick in phantom view;

FIG. 11 is a right side view of the frog cover of FIG. 9 showing the stick in phantom view;

FIG. 12 is a longitudinal sectional view taken along line 12—12 of FIG. 11 showing the bow frog and frog cover of FIG. 9;

FIG. 13 is an exterior surface plan view showing the frog cover pattern of FIG. 9;

FIG. 14 is a perspective view of the embodiment of FIG. 9 showing the exterior surface of the frog cover being positioned around a bow frog shown in phantom lines;

SPECIFICATION

The present invention relates to a removable, replaceable, and disposable bow frog cover 10 for covering the frog 12 of a bow 14 to provide a sufficient grip of the bow 14 for proper manipulation by the user and protect the frog 12 from deterioration due to moisture and wear.

Figure 1:
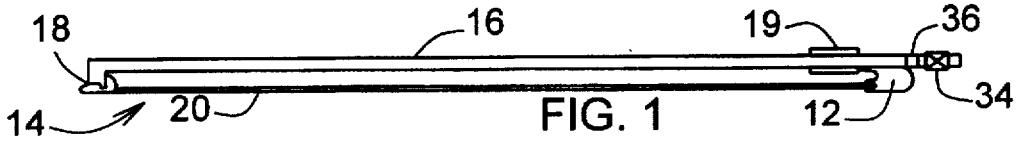
FIG. 1 is a perspective view of a musical instrument bow.
Figure 3:
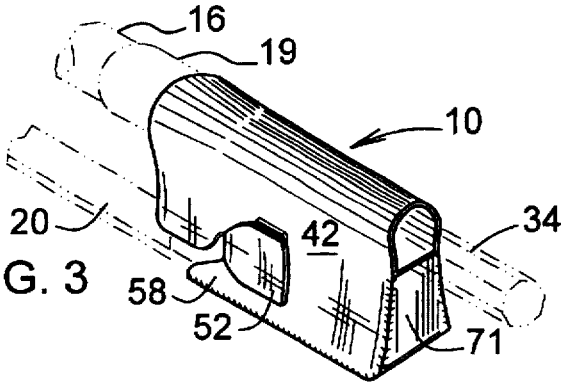
FIG. 3 is an enlarged perspective view of the frog cover of the present invention showing the stick in phantom lines.
Figure 4:
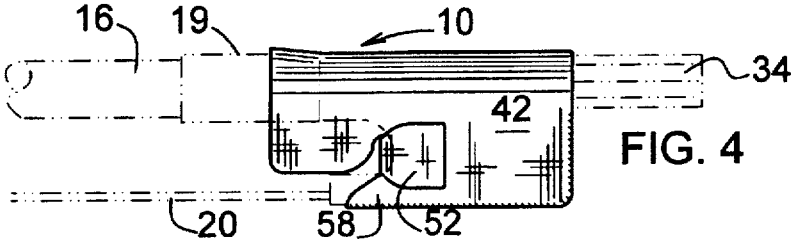
FIG. 4 is a left side view of the frog cover of the present invention showing the stick in phantom view.
Figure 5:
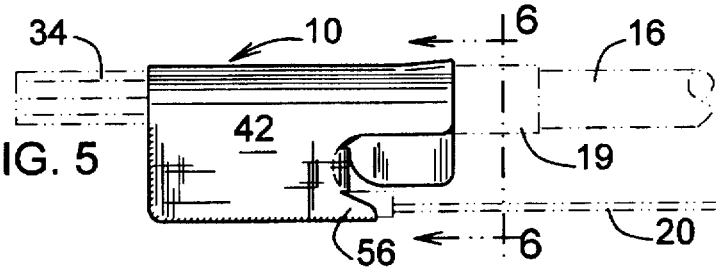
FIG. 5 is a right side view of the frog cover of the present invention showing the stick in phantom view.
Figure 6:
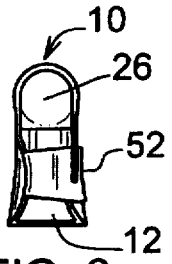
FIG. 6 is a longitudinal sectional view taken along line 6—6 of FIG. 5 showing the bow frog and frog cover of the present invention.

Referring now to the drawings, FIGS. 1–20 show the bow frog cover 10, wherein like reference numerals designate identical or corresponding parts throughout the several views. As shown best in FIG. 1, a musical instrument bow 14 comprises an elongated stick or rod 16, a tip 18 unit at the outer end of the rod 16, a movable block or frog 12 at the other inner end of the rod 16 and a sleeve 19. The frog 12 is longitudinally movable relative to the tip 18. Hair 20 is held taut between the tip 18 and the frog 12.

As illustrated in FIG. 2, the frog 12 of the bow 14 is composed of wood, plastic, metal or other suitable material. The frog 12 body has a cavity formed lengthwise therein for receiving the hair 20. The frog 12 has a front end 22 and a rear end 24. The forward end 22 of the frog 12 which defines the upper bow-engaging leg 26 of the U-shaped notch 28 in the frog 12 provides a thumb-receiving arch 30. The thumb generally rests around 22 and 26; the fingertips of the three long fingers of the right hand may rest on the opposite side of the arch 30. The fourth finger of the right hand may rest at the top of the rod 16 around the fitting 36. The frog 12 has a lower, hair carrying leg 32 defining a concave bottom surface and is mounted upon a curved slide of metal or the like within which is formed a hole.

At the frog 12 end of the rod 16, an elongated slot is formed longitudinally in the end of the rod 16 and through a fitting at the outer end thereof. The slot has an opening in one wall of the rod 16, and an elongated thumb screw 34 inserted through a fitting 36 and into the slot. A screw threaded stem cooperatively engages the slot. The outer end of the thumb screw 34 is adapted to abut and rotate against the fitting 36. This arrangement provides for sliding movement in a lengthwise direction of the frog 12 relative to the tip 18. In use of the frog 12, rotation of the thumb screw 34 moves the frog 12 along the rod 16. The thumb screw 34 is rotated so as to draw the frog 12 away from tip 18 and attain the appropriate tautness of the hair 20.

Figure 19:
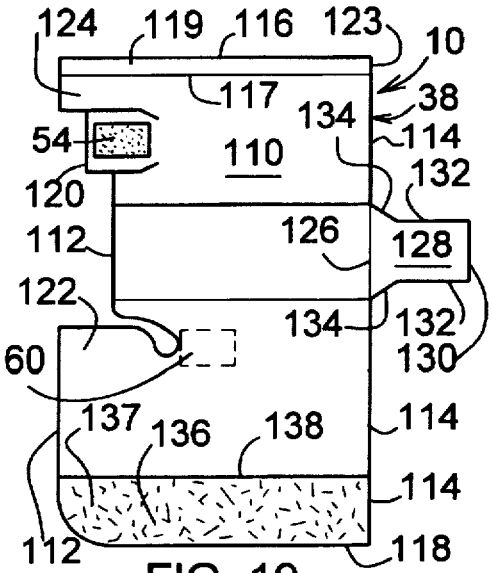
FIG. 19 is an interior surface plan view showing the frog cover pattern of FIG. 15.

The frog cover 10 of the present invention is manufactured from readily available materials and simple in design. The preferred embodiment is comprised of a sleeve of a thin absorbent material, (DEL Oct. 6, 1995) air permeable material such as swede leather which has the capability of absorbing moisture from the user's fingers and hands and yet prevent penetration of the moisture through the frog cover preventing degradation of the surface of the frog and adjacent gripping surfaces. However, it is contemplated that plastic, cloth, chamois, soft rubber or plastic, or other flexible synthetic nonpermeable materials can be used in combination with or substituted for the leather components of the present invention to provide good feel and offers a slip-resistant grip for the fingers that support the frog 12, and protect the bow frog 12 and wood from body oil and moisture, and yet remain attractive. The frog cover 10 may actually enhance the grip of the user depending upon the selection of the material of construction. It is contemplated that the frog cover 10 can be fabricated from material imitating the feel of wood (DEL Oct. 6, 1995) such as ebony. It is noted that a non air permeable frog cover 10 would have to be removed when not in use to allow the wood to breath or that a totally absorbent frog cover 10 would have to be removed to prevent moisture absorbance by the wood from the user's hand in order to prevent degradation. A multilayer frog cover 10 may be fashioned from two or more materials providing a moisture-resistant material in contact with the frog 12 and rod 16 and a moisture-absorbing material in contact with the user's fingers and hands. The preferred embodiment is fabricated by sewing together a one piece pattern or two piece pattern of material cut to the desired dimensions forming a template 38 as best shown in FIGS. 7, 13, and 19.

The frog cover 10 is slipped over the frog 12 and a releasable flap of material or tab secures the frog cover 10 into position. The frog cover 10 may be quickly and easily applied and removed, and preferably can be used not only for practice, but also for concerts. It is also contemplated that a one piece unit may be formed or molded from a synthetic material such as plastic or rubber which could be slipped on the frog 10 and held in position by a friction fit for providing the desired moisture repelling characteristics necessary to protect the frog and wood adjacent thereto.

Figure 7:
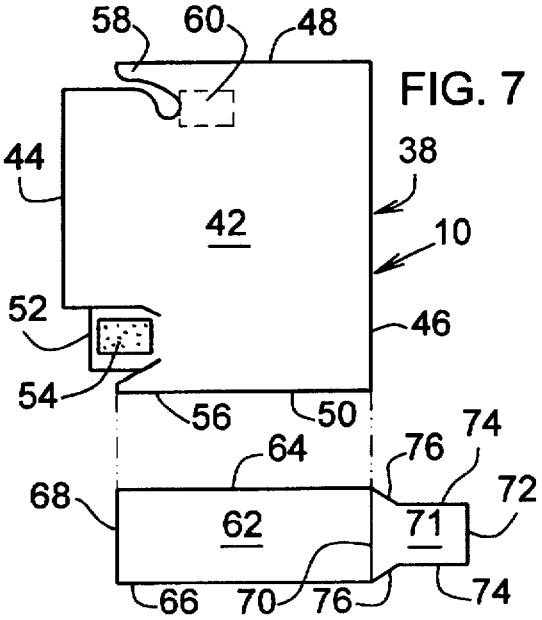
FIG. 7 is an exterior surface plan view showing a frog cover pattern.
Figure 8:
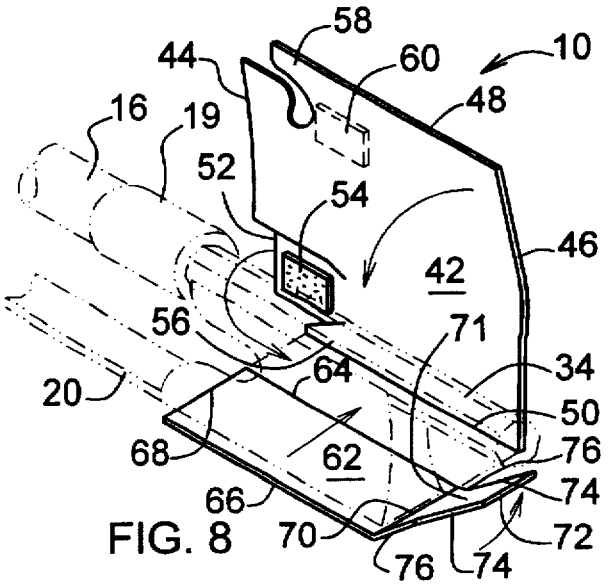
FIG. 8 is a perspective view of the present invention showing the interior surface of a frog cover which is being positioned around a bow frog shown in phantom lines.
Figure 15:
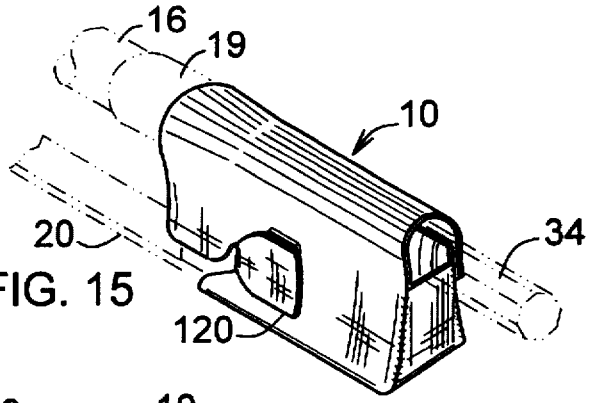
FIG. 15 is an enlarged perspective view of an alternate embodiment of the frog cover of the present invention showing the stick in phantom lines.
Figure 16:
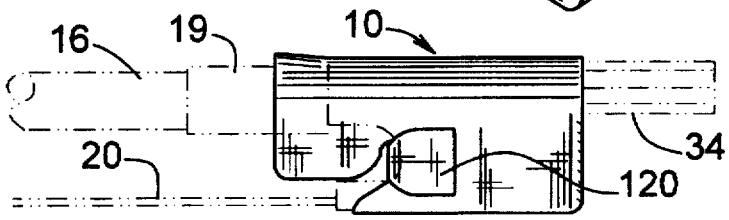
FIG. 16 is a left side view of the frog cover of FIG. 15 invention showing the stick in phantom view.
Figure 17:
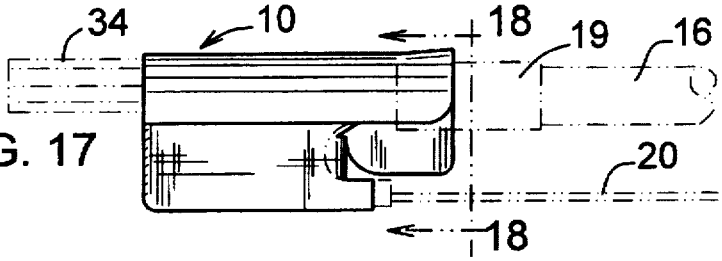
FIG. 17 is a right side view of the frog cover of FIG. 15 showing the stick in phantom view.
Figure 18:
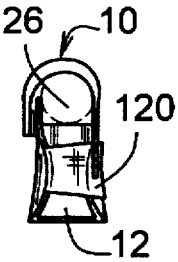
FIG. 18 is a longitudinal sectional view taken along line 18—18 of FIG. 17 showing the bow frog and frog cover of FIG. 15.

More particularly, one preferred embodiment is shown in FIGS. 3–8. As shown in FIG. 7, the frog cover has a first piece or first sheet 42 of material defining a front edge 44, rear edge 46, first side edge 48, second side edge 50. A tab 52 includes a first hook and loop holding means 54, such as VELCRO™, a first side supporting edge 56, a second side supporting edge 58, and a hook and loop holding means 60 for cooperative engagement with a second hook and loop holding means 54 for removing securing the frog cover 10 immovably around the frog 12. The tab 52 is removably connected to the front bottom portions of the opposing side edge 48, 52. As shown in best in FIG. 8, to size the frog cover 10, the first sheet 42 of the frog cover 10 is wrapped around the frog 12. A second sheet 62 defines a first side edge 64, a second side edge 66, a front edge 68, and a rear edge 70 connecting a flap 71 defining a distal top end 72 having equidistant side edges 74 extending outwardly and downwardly forming flared edges 76 connecting with the rear edge 70.

The frog cover 10 is formed by connecting by glue or thread, the first side edge 48 of the first sheet 42 with the second side edge 66 of the second sheet 62; the second side edge 50 of the first sheet 42 to the first side edge 64 of the second sheet 62; and the rear edge 46 of the first sheet 42 to edges 74 and 76 of flap 71 of second sheet 62. It should be noted that only edges 74 and 76 of flap 71 are connected to the edge 46 or first sheet 42. An opening is formed by connection of first sheet 42 and edge 46 to facilitate extension of the rod 16 and thumb screw 34 therethrough.

As shown in FIGS. 3–6, the front edge 44 of the first sheet 42 is folded around the top of the rod 16 joining the frog 10, and the first and second side edges, 56 and 58, respectively, are folded around the lower hair carrying leg 32 of the frog 12. The flap 52 is wrapped securely around the U shaped notch 28 between the front upper bow engaging leg 26 and lower hair engaging leg 32 and secured thereto by the cooperative engagement of the hook and loop fastening means 54 and 60.

A second preferred embodiment is shown in FIGS. 9–14. As shown in FIG. 13, the frog cover 10 comprises a single sheet 78 of material defining a front edge 80, rear edge 82, first side edge 84, second side edge 86, tab 88 including a first hook and loop holding means 54, such as VELCRO™, first side supporting edge 90, second side supporting edge 92, hook and loop holding means 60 for cooperative engagement with a second hook and loop holding means 54 for removing securing the frog cover 10 immovably around the frog 12. The tab 88 is removably connected to the front bottom portion of the opposing side edge 90 (DEL Oct. 6, 1995). A rear crease edge 94 connecting a flap 96 defining a distal top end 98 having equidistant side edges 100 and 101 (DEL Oct. 6, 1995) extending outwardly and side edge 101 (DEL Oct. 6, 1995) and downwardly connecting with the rear edge 102 of side flap 104 formed by crease 106 being defined by side edge 86 and second front edge 108.

As shown in FIG. 14, the single sheet 78 is wrapped around the frog 12 and the first side edge 84 is connected to the second side edge 86, the side edge 101 of tab 96 is connected to bottom edge 102. The top end 98 is connected to the lower portion of rear edge 82. The side edge 100 and top portion of rear edge 82 form an opening to facilitate extension of the thumb screw 34 of the bow rod 16 therethrough. As shown in FIGS. 6–12, the front edge 80 of the sheet 78 is folded around the top of the rod 16 joining the frog 10, and the first and second side edges, 84 and 86, respectively, are folded around the lower hair carrying leg 32 of the frog 12. The flap 88 is wrapped securely around the U shaped notch 28 between the front upper bow engaging leg 26 and lower hair engaging leg 32 and secured thereto by the cooperative engagement of the hook and loop fastening means 54 and 60.

A third preferred embodiment is shown in FIGS. 15–20. As shown in FIG. 19, the frog cover 10 comprises a single sheet 110 of material defining a front edge 112, rear edge 114, first side edge 116, inner crease 117 forming side tab 119 having a hook and loop holding means 123 such as VELCRO™ on the exterior surface, second side edge 118, tab 120 including a first hook and loop holding means 54, such as VELCRO™, first side supporting edge 122, second side supporting edge 124, hook and loop holding means 60 for cooperative engagement with a second hook and loop holding means 54 for removing securing the frog cover 10 immovably around the frog 12. The tab 120 is removably connected to the front bottom portion of the opposing side edge 112. A rear crease edge 126 connecting a flap 128 defining a distal top end 130 having equidistant side edges 132 extending outwardly and downwardly forming flared edges 134 connecting with the rear edge 114. Side flap 136 having a hook and loop holding means 137 such as VELCRO™ on the interior surface for removable attachment to the exterior surface 123 of side tab 119, is formed by crease 138.

Figure 20:
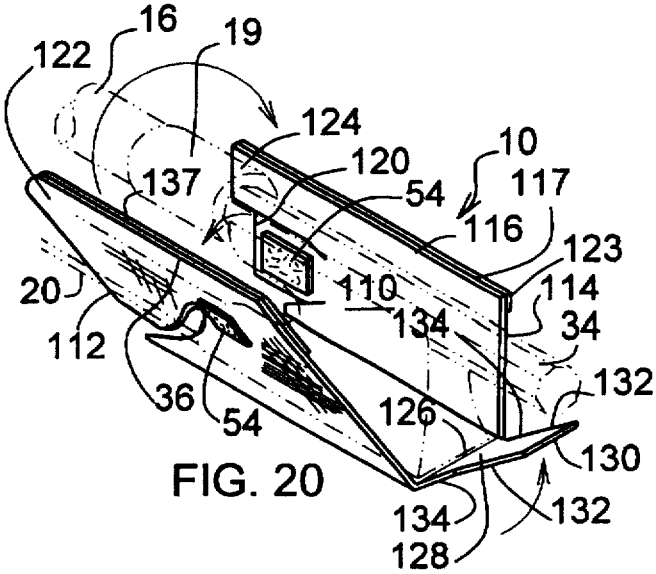
FIG. 20 is a perspective view of the embodiment of FIG. 15 showing a frog cover being positioned around a bow frog shown in phantom lines.

As shown in FIG. 20, the single sheet 110 is wrapped around the frog 12 and the first side edge 116 of tab 119 is connected to the second side edge 118, the side edges 132 and 134 of tab 128 are connected to rear edge 114. As shown in FIGS. 15–18, the front edge 112 of the sheet 110 is folded around the bottom of the frog and lower hair engaging leg 32 (DEL Oct. 6, 1995). The first and second side edges, 116 and 118, respectively, are folded around the top of the rod 16 joining (DEL Oct. 6, 1995) the frog 12. The flap 120 is wrapped securely around the U shaped notch 28 between the front upper bow engaging leg 26 and lower hair engaging leg 32 and secured thereto by the cooperative engagement of the hook and loop fastening means 54 and 60.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

I claim:

1. A frog cover for a bow; the bow including hair, a bow rod and a bow frog, the bow frog including a top portion and an opposite bottom portion and opposed side edges; the bow frog movably mounted at the top portion to the bow rod; the bottom portion of the bow frog receiving the hair at one of the opposed side edges; the frog cover comprising:

a sleeve slidably engaging the bow; said sleeve comprising at least one sheet of material and a means for holding said sleeve in position covering a portion of the bow rod adjacent the bow frog, the bottom portion of the bow frog and the other of said opposed side edges; said at least one sheet of material including a first front side edge, a second front side edge and a rear side edge.

2. The frog cover of claim 1, wherein said means for holding said sleeve in position comprises a detachable tab.

3. The frog cover of claim 2, wherein said first holding means and second holding means comprises hook and loop fasteners.

4. The frog cover of claim 1, wherein said sleeve comprises an adsorbent material.

5. The frog cover of claim 1, wherein said sleeve protects the frog and said portion of said bow rod covered by said frog from moisture.

6. The frog cover of claim 1, wherein said sleeve is selected from the group of materials consisting essentially of leather, cloth, flexible plastic, chamois, and velour.

7. The frog cover of claim 1, wherein said sleeve comprises an inner moisture-resistant material in contact with said frog and said portion of said bow rod, and an outer moisture-absorbing material in contact with the user's fingers and hands.

8. The frog cover of claim 1, wherein said rear side edge including an aperture for extension of a distal end of said bow rod therethrough.

9. The frog cover of claim 1, wherein said sleeve comprises a one piece pattern of material connected together by means for holding.

10. The frog cover of claim 9, wherein said means for holding is thread.

11. The frog cover of claim 9, wherein said means for holding is hook and loop fasteners.

12. The frog cover of claim 1, wherein said sleeve comprises a two piece pattern of material connected together by means for holding.

13. The frog cover of claim 12, wherein said second means for holding is thread.

14. The frog cover of claim 12, wherein said means for holding is hook and loop fasteners.

* * * * *